United States Patent [19]

Lee et al.

[11] Patent Number: 4,573,505

[45] Date of Patent: Mar. 4, 1986

[54] CONTAINER WASHING AND FILLING MACHINE

[75] Inventors: Graham L. Lee; Jeffrey R. Shuttlewood, both of Kent; John W. Ambrose, Rainham, all of United Kingdom

[73] Assignee: APV Burnett & Rolfe Ltd., Rochester, England

[21] Appl. No.: 600,285

[22] Filed: Apr. 13, 1984

[30] Foreign Application Priority Data

Apr. 20, 1983 [GB] United Kingdom ..... 8310665

[51] Int. Cl.[4] ..... B65B 3/04; B67C 3/26

[52] U.S. Cl. ..... 141/92; 141/273; 141/350; 53/266 R

[58] Field of Search ..... 141/1–12, 141/85–92, 250–284, 154, 325, 326, 327, 350; 53/266 R

[56] References Cited

U.S. PATENT DOCUMENTS 3,277,929 10/1966 Cook ..... 141/92

*Primary Examiner*—Houston S. Bell, Jr.

*Attorney, Agent, or Firm*—Kokjer, Kircher, Bradley, Wharton, Bowman & Johnson

[57] ABSTRACT

A container washing and filling machine for washing and filling blow moulded containers 1 having an open-ended neck 2 includes only a single head 5 through which both washing and filling liquid is introduced into the container 1 through its open-ended neck 2. The container 1 is held in fluid-tight sealing engagement with the single head 5 by a clamping device 32 and the clamping device and single head 5 are movable together with a container 1 being treated between a washing position in which the container 1 is inverted and a filling position in which the container 1 is erect. Preferably the machine also inlcudes a closure unit 21 to apply a closure to the open-ended neck 2 of a filled container 1.

20 Claims, 10 Drawing Figures

CONTAINER WASHING AND FILLING MACHINE

BACKGROUND OF THE INVENTION

This invention relates to a container washing and filling machine for washing and filling containers with liquid.

Recently, it has been proposed to use thin walled containers made from a thermoplastics material including a short neck at their top with an open end. The neck includes a collar surrounding it. The containers are typically packed in a cardboard carton and may be used with a dispensing device. It is intended that the containers are disposable so that they are only filled once and then, after their liquid contents are exhausted, they are thrown away.

One such container is generally spherical and may have a capacity of approximately 25 liters, 20 liters, 15 liters or 10 liters corresponding approximately to a fifth, a sixth, an eighth and one twelvth of a U.S. barrel, respectively. Another such container is generally oval in shape with two hemispherical ends joined by a cylindrical portion. These containers may be filled with potable liquids, especially beer, but also other carbonated beverages, wine and fruit juices. They may also be used for other bulk packaging for the catering industry and so contains such food liquids as soup, gravy, ketchup and sauces.

Such containers are prepared by blow moulding a preform or parison and the blow moulding operation on the preform or parison may be carried out in a container filling plant immediately before the containers are washed and filled. The present invention is particularly concerned with a washing and filling machine for handling such containers.

Conventionally bear and other carbonated beverages have been distributed in multi-use metal containers called kegs. Kegs are very robustly constructed and include a valve to close and seal the mouth of the container and also include an internal spear which extends from the mouth to the base of the key. When the keg is erect liquid to be dispensed from it is drawn through the spear. Conventional kegs are usually inverted whilst they are washed and the keg washing machine includes a washing head which opens the valve and introduces a washing liquid into the inside of the keg, usually through the spear. The cleaning liquid scours the inside of the keg and then leaves the mouth of the keg through the washing head. Usually a variety of washing liquids are used, for example a detergent cycle followed by a rinse cycle. Finally steam is usually introduced into the inside of the keg to sterilize it. Typically the keg is moved from a washing station to a separate sterilizing station in between the washing and sterilizing steps and the steam introduced into the inside of the keg by a separate sterilizing head. In a conventional keg washing and racking machine the keg is then moved to a downstream racking station in which it is filled with beer or other carbonated beverage. The valve in the mouth of the keg closes automatically as the keg is removed from the washing or sterilizing head to keep the keg closed and the inside of the keg free from contamination between the washing and sterilizing steps and between the sterilizing and racking steps.

Beer or other carbonated beverage may be introduced into the keg whilst it is inverted and in this case gas displaced from inside the keg is vented through the spear. However, many such washing and racking machines turn over the keg between the washing and racking stations. One example of this type of machine is described in U.S. Pat. No. 3,831,645. When the keg is erect as it is filled, the beer or other carbonated beverage is usually introduced into it through the spear to reduce the generation of fob or foam. Whilst conventional keg washing and racking machines are completely satisfactory for washing and filling metal kegs it is not possible to use them to wash and fill blow moulded containers having an open-ended neck described above.

SUMMARY OF THE INVENTION

According to this invention a container washing and filling machine for washing and filling blow moulded containers having an open-ended neck includes only a single head through which both washing and filling liquids are introduced into the container through its open-ended neck, means to supply a washing liquid to the single head, means to supply a filling liquid to the single head, a clamping device to hold the open-ended neck of the container in fluid-tight sealing engagement with the single head, and means to move the single head and clamping device together with a container being treated between a washing position in which the container is inverted and a filling position in which the container is erect whilst maintaining a fluid-tight sealing engagement between the single head and the open-ended neck of the container.

Since both the washing and the filling is carried out by the same head, and since the open neck of the container remains engaged with that head during the entire washing and filling operation, there is no possibility of the inside of the container being contaminated between the washing and filling operations in spite of the container having an open-ended neck. When the containers are washed in the inverted position the washing liquid can be readily discharged. The operation that is carried out on the containers immediately after filling is to apply a closure to the open neck of the container and naturally the container must be in an erect position for this operation and it is therefore desirable to fill the container when it is erect.

Preferably the container washing and filling machine includes a support which supports the base of the container during filling. The support is preferably movable up and down and arranged to move up into contact with the base of the container only after the container has been moved into its erect position at the start of the filling operation. Preferably the support is moved up and down by a pneumatic ram.

Preferably the container washing and filling machine also includes a closure unit to apply a closure to the open neck of the filled container. Typically, at the end of the filling operation, the open neck of the filled container is released from the single washing and filling head and this head then returns to its washing position to receive the next container. The closure unit is then located over the open neck of the container and a closure is applied to the open neck of the filled container to seal it. Especially when the liquid filling of the container is a carbonated liquid such as beer, there is inevitably some fob formed which fills any ullage remaining between the top of the liquid and the open end of the neck of the container and since the fob fills this space, air and any other contaminant does not enter the open neck of the container in between the filling operation and its closure by the closure unit. When the liquid filling of the container is not a carbonated beverage an inert gas may be injected by the closure unit into the container to fill any space remaining in the top of the container. The support which engages the base of the container during filling continues to support the container after the combined washing and filling head releases the container and during application of the closure by the closure unit. After the open neck of the container has been closed and the container released from the closure unit the support is lowered and the filled and closed container is then discharged from the machine.

Preferably the container washing and filling machine also includes a discharge conveyor and as the filled and closed container is discharged it is deposited on the discharge conveyor. Preferably the discharge conveyor carries a stream of empty cartons and the filled container is loaded into a carton on the discharge conveyor.

Preferably the means to move the single washing and filling head and the clamping device not only turns over the head and the clamping device to rotate the container between an inverted position in which it is washed to an erect position in which it is filled, but also displaces the container in a horizontal plane during this movement. In this way, when the means returns the single washing and filling head and the clamping device to its inverted position to receive a further container to be washed and filled it is also displaced horizontally from the container which has just been filled and the closure unit. Thus the container which has just been filled and the closure unit do not interfere with the loading of the next container onto the single washing and filling head. Preferably the closure unit is moved through substantially 90° in a horizontal plane to bring it into position to close the open ended neck of a container and then returned to a position away from this position to ensure that the following washed container can be moved into its filling position without interfering with the closure unit.

Preferably the container washing and filling machine is semi-automatic in operation and manually fed so that the containers to be filled are placed on the filling head manually, but thereafter, the containers are washed, filled, closed and discharged completely automatically. Naturally, the machine may also be fed automatically either by a robot, or by the washing and filling machine receiving the containers directly from the blow moulding machine immediately after they are formed.

Preferably the means to supply a washing liquid to the single head is arranged initially to supply a washing liquid so that a container is washed with a washing liquid, then to supply a gas purge, typically an air purge, to ensure that all the washing liquid is discharged from the container, then to supply a rinsing liquid, typically clean water to rinse the container, and then a gas purge to discharge the rinsing liquid. As part of the means to supply the washing and filling liquids the container is preferably pressurised with a suitable gas, which in the case of carbonated beverages is carbon dioxide, but in the case of other potable food liquids and beer, may be an inert or at least, non-oxidising gas, such as nitrogen. Typically the gas used to purge the rinsing water from the container is that used to pressurise the container. The means to supply the filling liquid then supplies the filling liquid and this is fed through the head to fill the container with the liquid against the back pressure of the gas pressurising the container whilst allowing the gas pressurising the container to be displaced by the filling liquid. Finally the container is depressurised after the filling is complete. Since the containers have not been used previously they are not heavily contaminated, particularly with bacteriologically active agents and thus, especially when the containers have only just been blow moulded, the washing action is principally to remove any debris such as plastics material or other contamination resulting from the blow moulding operation. Frequently these can be removed satisfactorily by using simply hot water as the washing liquid. However, instead of, or as well as, the inside of the containers may be contacted by a sterilizing fluid. Typically this is a chemical sterilant such as a hypochlorite solution or a solution of sulphur dioxide, or a sterilizing gas such as sulphur dioxide.

Preferably the clamping device is arranged to clamp onto the collar surrounding the neck of the container and, in this way hold the open-ended neck of the container against the head. In this case the clamping device includes at least two claws pivotally connected to a body which is movable with respect to the combined washing and filling head by a fluid pressure operated ram, the clamping device also including fulcrum means which engage the claws so that downwards movement of the body carries the claws downwards and reaction from the fulcrum means closes the claws behind the collar on the neck of the container; further downwards movement of the body engaging the claws with the face of the collar remote from the open end of the neck and urging the container downwards to move the open end of the neck of the container into fluid tight sealing engagement with the washing and filling head.

Preferably each of the claws is generally C-shaped with one end pivotally connected to the movable body and the other end being arranged to engage the collar on the neck of the container. In this case the fulcrum means is pivotally connected to the claws at the corner adjacent the pivotal connection with the body and is spring biased. Downwards movement of the body initially moves the pivoted end of the claws downwards which, in turn, causes the claws to turn about their pivotal connections with the fulcrum means so that the other ends of the claws move towards one another. Further downwards movement of the body then causes the claws to move downwards with the fulcrum means also moving downwards against their spring bias.

Preferably the fluid pressure operated ram is pneumatically operated and preferably there are only two claws each having a curved jaw formed at their other ends to fit around the circular neck of the container behind the collar.

One problem that occurs when filling an erect container is that if the liquid is simply poured into the neck of the container it falls through the gas space in the container and so as fob or foam of an intimate mixture of liquid and gas is formed. This effect is particularly noticeable when the filling is a carbonated beverage. As further liquid is introduced into the container it passes through the fob and generates an even greater quantity of fob and so, very rapidly, the entire container is filled with fob which effectively prevents the introduction of further liquid. Even when the liquid is not carbonated, for example in the case of wine, fruit juice or other food liquid, it is undesirable to mix intimately the liquid with the gas in the container.

Conventionally, when filling a key with a carbonated beverage the keg includes a spear and the liquid is introduced into the base of the container by feeding it through the spear. Once an initial quantity of liquid has been introduced, the remainder is introduced beneath the surface of the liquid and so does not mix with the gas in the container and so generate a great quantity of fob nor introduce an undesirable quantity of gas into the liquid.

Preferably the single washing and filling head includes an annular outwardly directed orifice through which the filling liquid is introduced into the container, so that it is introduced in a direction generally sideways and outwards from the filling head and so that it flows smoothly around the continuous internal hemispherical side wall surrounding the neck of the container without mixing with and introducing excessive quantities of gas and without the resulting generation of an excessive quantity of fob. This effect is achieved both with a generally spherical container and with a generally oval container.

Alternatively, the single washing and filling head may include an extendable spear, and means to withdraw the spear during loading and washing of the container and extend the spear into the container until its end is adjacent the base of the container during filling. In this case, preferably the single washing and filling head includes a number of concentric tubes with the central tube providing the inlet for the filling liquid and, around this central tube an annular orifice through which the washing, sterilizing and rinsing liquid is supplied during washing of the container. The central tube may form the spear and be movable into and out of the container or, alternatively, a spear may surround the central tube and be movable into and out of the container effectively to extend the central tube during filling.

Since the entire washing and filling head has to rotate so that the containers are washed in their inverted position and then filled in an erect position it is naturally desirable for the length and bulk of the washing and filling head to be reduced as far as possible. This is why it is much preferred to introduce the filling liquid through an outwardly directed annular orifice. The extendable spear is preferably moved by a pneumatic ram and, in general, a pneumatic ram has to be at least twice as long as the extent of movement that is required. This naturally makes the overall length of the washing and filling head including an extendable spear large and makes it cumbersome to rotate.

This difficulty may be reduced by using a telescoping pneumatic ram to move the spear or, when the spear surrounds the central tube, by using the spear as the piston rod of a pneumatic ram so that the overall length of the washing and filling head is not much greater than the length of movement of the spear.

BRIEF DESCRIPTION OF THE DRAWINGS

A particular example of a container washing and filling machine in accordance with this invention for filling spherical containers with beer together with various modifications, will now be described with reference to the accompanying drawings, in which.

DESCRIPTION OF PARTICULAR EXAMPLES

Figure 1:
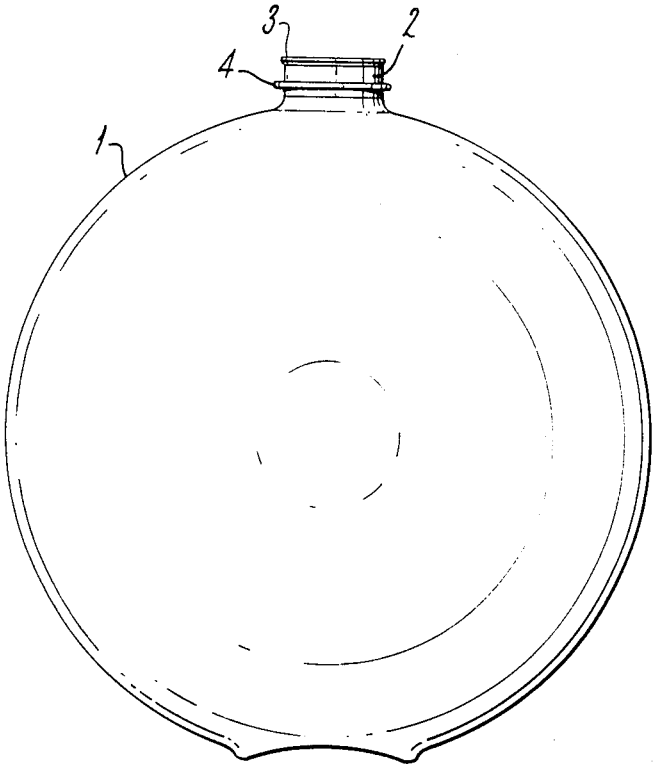
FIG. 1 is a side elevation of the container to be filled.

The container with which this invention is particularly intended to be used is known as a "beer sphere". The container is shown in FIG. 1 and comprises a spherical body 1 with a short cylindrical neck 2 at the top. The neck 2 includes an open end 3 with a peripheral bead and an annular collar 4. The size of the beer sphere varies with its capacity but typically the quarter of a U.S. barrel size which contains about 25 liters is 337 mm in diameter.

The washing and filling machine includes a single washing and filling head 5 mounted on a rotatable shaft 6 which is driven by a pneumatic rotary actuator 7. The shaft 6 is hollow and divided longitudinally into a number of separate compartments. The shaft 6 is surrounded by stationary manifolds 8, 9 and 10 and each include rotary seals (not shown). The hollow shaft 6 includes apertures inside the manifolds 8, 9 and 10 and rigid pipe connections 11, 12 and 13 are provided between the inside of the hollow shaft 6 and the washing and filling head 5. Rigid pipe connections 14, 15 and 16 are also connected to the manifolds 8, 9 and 10 respectively and to a battery of solenoid controlled inlet valves 17, inlet valve 18 and exhaust outlet 19 respectively.

Washing liquid, rinsing liquid and two different purge gases are fed via the battery of inlet valves 17 through the pipe 14 and manifold 8 into the inside of the shaft 6. From here they then pass through the pipe 11 to the filling head 5. Beer passes through the solenoid controlled valve 18, the pipe 15, the manifold 9 and into the inside of the shaft 6 and then through the connection 12 to the filling head 5. The exhaust outlet which forms the drain during the washing operation and the vent outlet during the filling operation from the head 5 communicates via the pipe 13 to the inside of the shaft 6 then through the manifold 10 and the pipe 16 to the outlet 19. By using the manifolds 8, 9 and 10, these connections are established irrespective of the position of the filling head 5.

Figure 4:
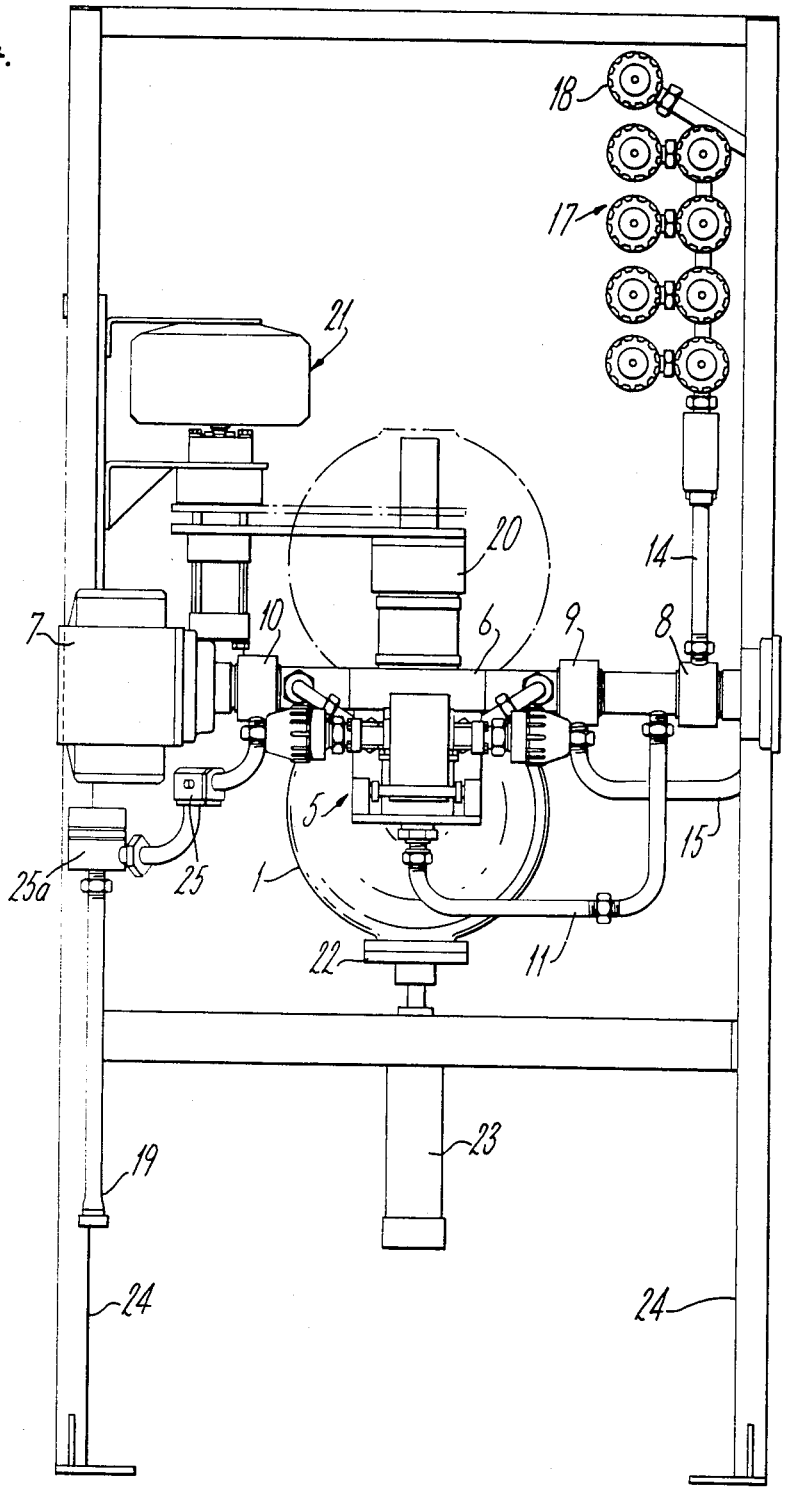
FIG. 4 is a front elevation of a container washing and filling machine with one filled container being capped and a second container being washed.

The washing and filling machine also includes a capping unit 20, shown most clearly in FIG. 4, a second pneumatic rotary actuator 21 for moving the capping unit into and out of its operative position, and a support plate 22 mounted on a pneumatic ram 23. All of the components are mounted on a supporting frame 24.

In operation, an operator places a container 1 onto the washing and filling head 5 and then actuates a cycle start button (not shown). The container is locked onto the washing and filling head as will be described in detail subsequently and then hot water is fed via the valves 17, the pipe 14 and pipe 11 to the head 5 and to the inside of the container 1. This hot water carries any dirt and debris with it is discharged through the head 5 via the pipes 13 and 16, and through the outlet 19. Compressed air is then fed via one of the battery of valves 17, the pipes 14 and 11 to the head 5 and used to purge all of the washing water from the inside of the container. When air alone is being discharged through the outlet 19, as sensed by a conductivity monitor 25, the feed of compressed air is stopped and replaced by a feed of rinse water via another of the valves 17. After a predetermined time, the supply of rinsing water is interrupted and replaced by a supply of carbon dioxide or nitrogen gas through another of the valves 17, pipes 14 and 11 and head 5. This purges the rinsing water and when the conductivity sensor 25 again detects the absence of water an associated valve 25*a* is closed to build up carbon dioxide or nitrogen under pressure inside the container 1.

Figure 2:
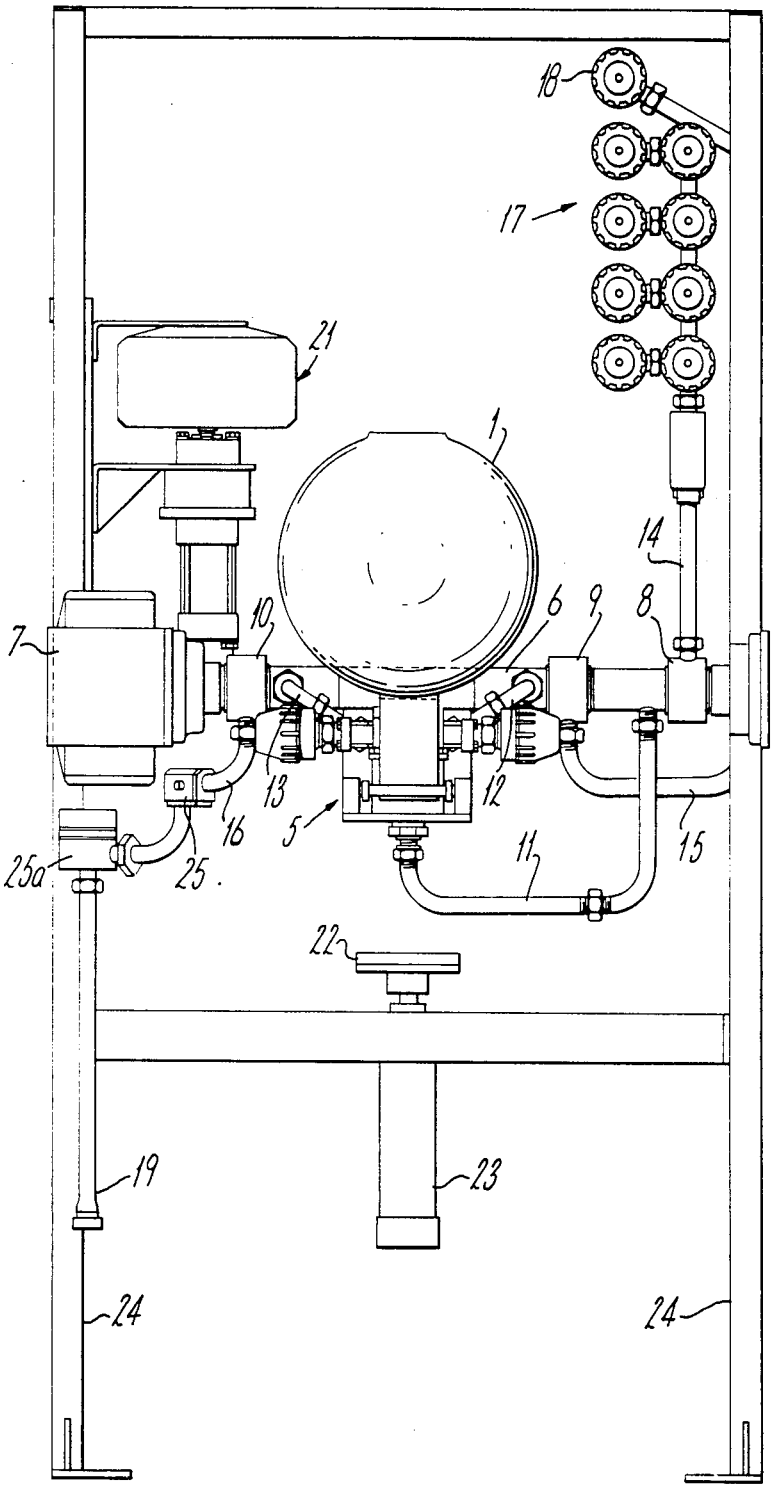
FIG. 2 is a front elevation of the container washing and filling machine with the container being washed.
Figure 3:
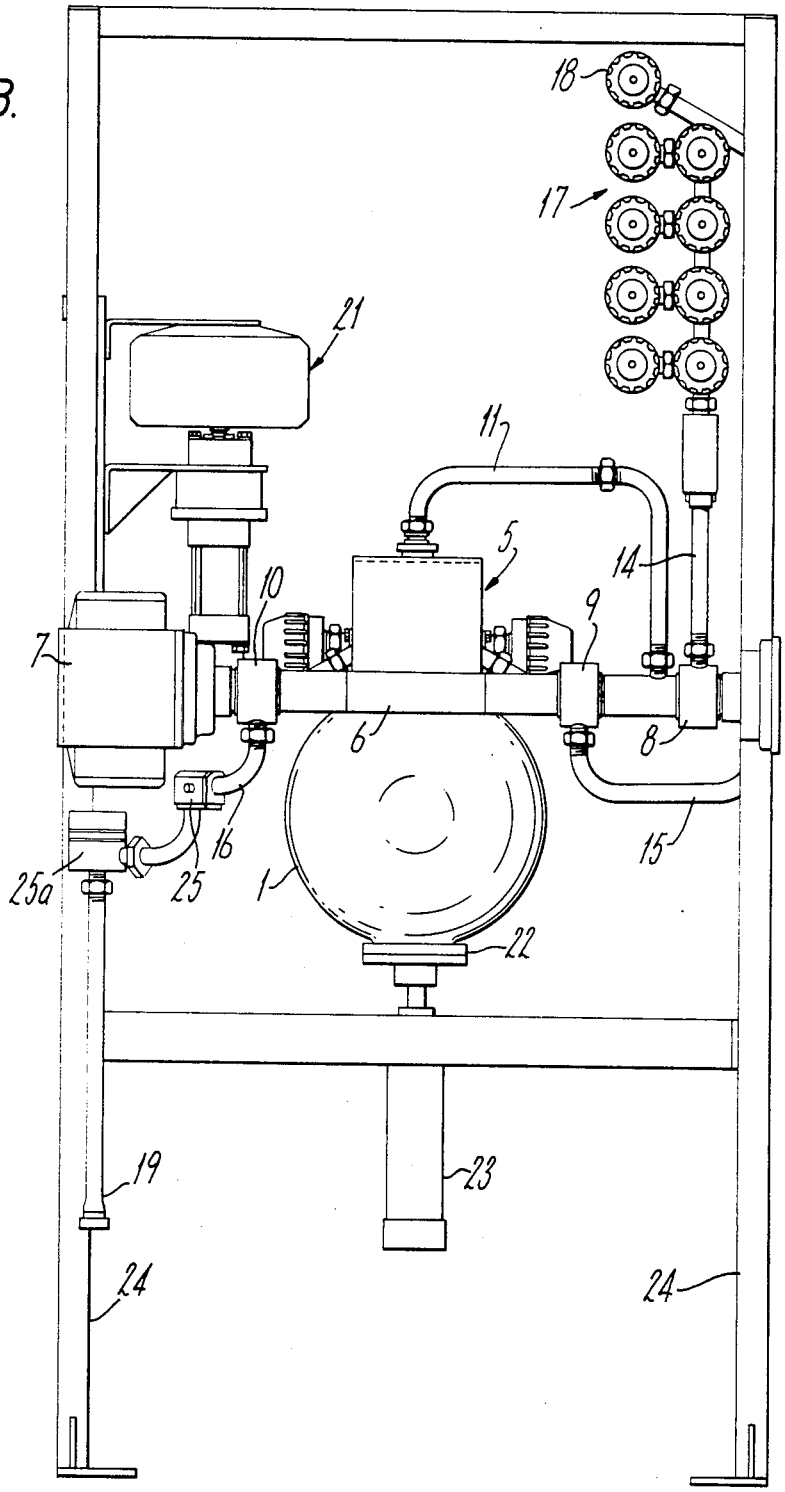
FIG. 3 is a front elevation of the container washing and filling machine with the container being filled.

During this time the rotary actuator 7 is actuated to move the container from its inverted position shown in FIG. 2 into its erect position shown in FIG. 3. This rotary movement by the actuator 7 also displaces the container in a horizontal plane. Once the predetermined pressure has been created in the container 1 and the container 1 has reached the position shown in FIG. 3, beer is dispensed into the container 1 via the valve 18, the pipes 15 and 12 and the filling head 5. The pneumatic ram 23 is actuated to raise the support plate 22 so that it engages the base of the container 1 and whilst beer is being introduced into the container 1 the pressure of carbon dioxide or nitrogen gas is maintained by the valve 25*a* and the gas displaced by the introduction of the beer is vented through the outlet 19.

At the completion of the filling operation the container 1 is depressurised by venting it through the outlet 19 and then the neck of the container is released by the head 5. The actuator 7 is then actuated to return the head 5 to its starting position so that the next container can be loaded onto it. The rotary actuator 21 is then actuated to move the capping unit 22 into position on the neck 2 of the container. The capping unit applies a closure to the open end 3 of the neck 2 of the container and crimps the closure around the bead surrounding the open end 3 of the container. The closure unit is conventional in construction and is model No. T-BS-021-0013P made by Johnson Enterprises Inc., of Rockford, Ill. The pneumatic ram 23 is de-actuated to lower the support plate 22 and the container 1. This movement discharges the container 1 from the washing and filling station and the filled and closed container is lowered into a carton on a discharge conveyor (not shown). The actuator 21 then moves the capping unit 20 through about 90° to return it to its out of use position. Whilst the capping unit 20 is capping the filled container 1 and this is being discharged, the next container which is shown in chain-dotted lines in FIG. 4 is being washed, pressurised and moved into the filling position.

Figure 5:
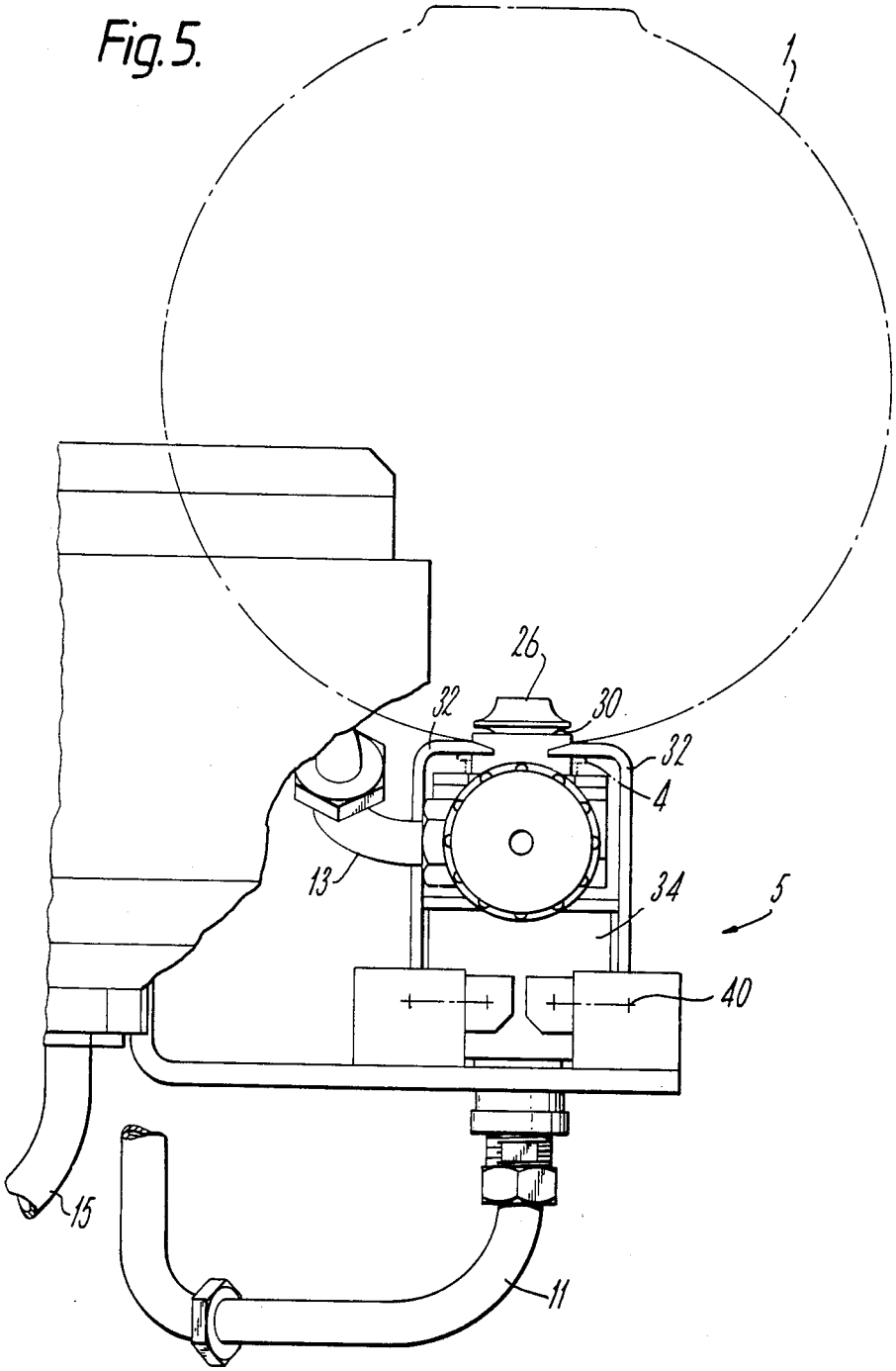
FIG. 5 is a side elevation to a larger scale showing the washing and filling head.
Figure 6:
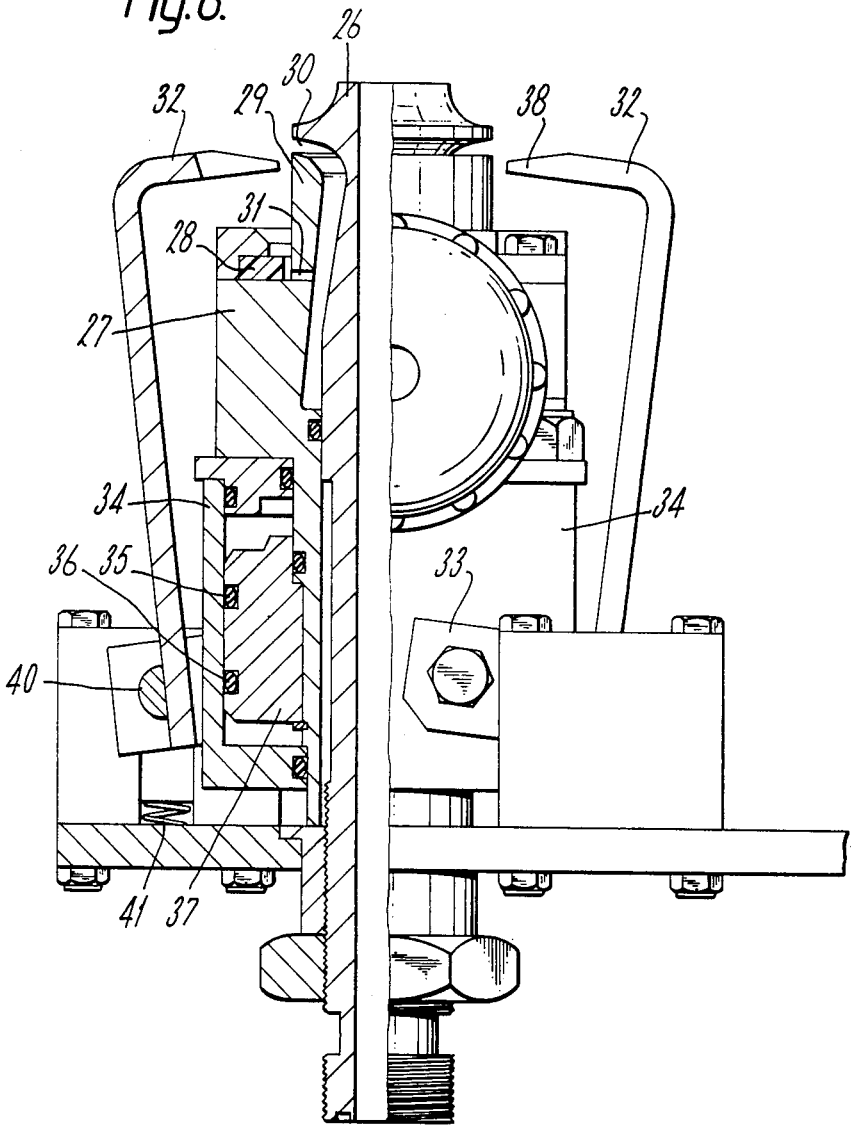
FIG. 6 is a partly sectioned side elevation of the washing and filling head to a still larger scale.
Figure 7:
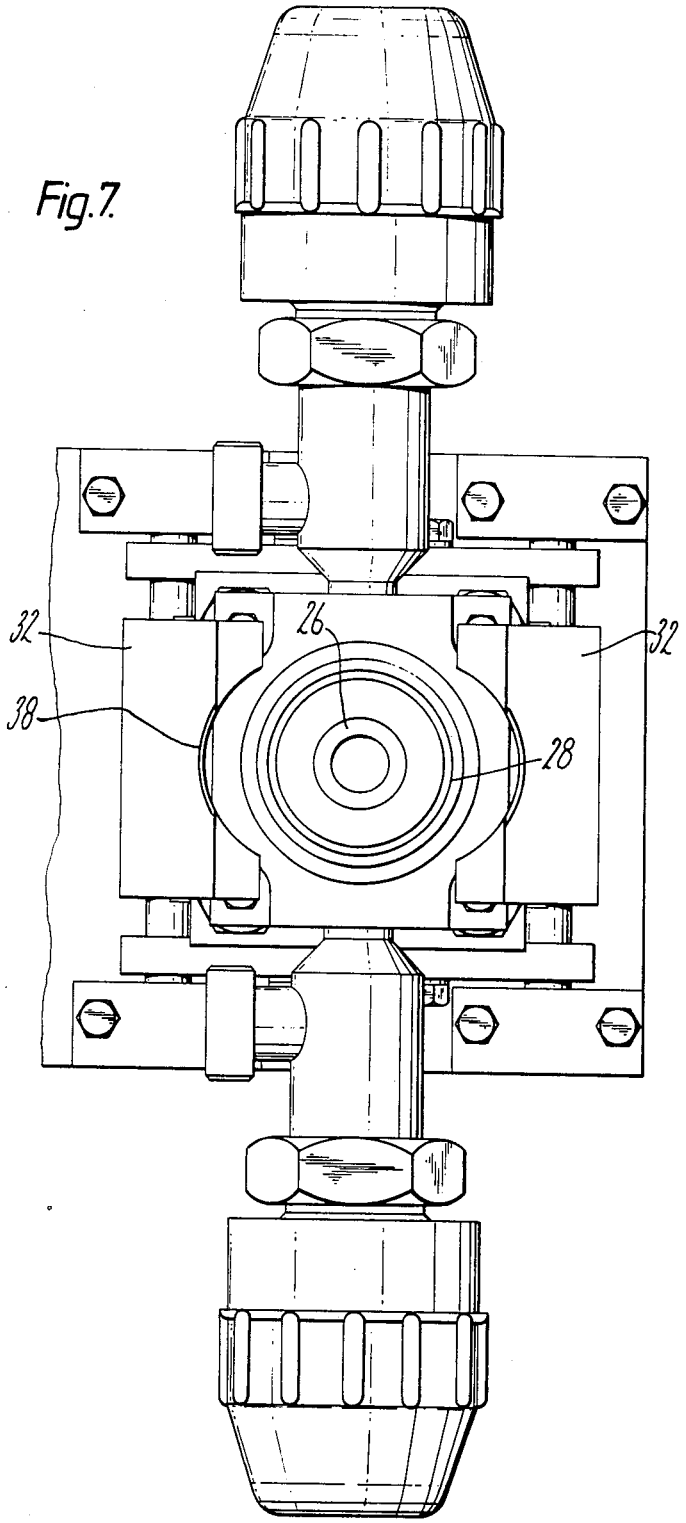
FIG. 7 is a plan of the washing and filling head.

The single washing and filling head 5 is shown in more detail in FIGS. 5, 6 and 7. The washing and filling head comprises a central tubular portion 26 through the centre of which the washing and rinsing liquids and purging gases are fed, a surrounding portion 27 which includes a resilient sealing ring 28 to engage against the open end 3 of the neck of the container and an upstanding cylindrical lip 29. An outwardly directed annular orifice 30 is formed between the portions 26 and 29 and, during filling, beer is fed into the container through this annular orifice 30. Thus the beer is directed outwards onto the internal spherical side wall of the body 1 of the container and flows smoothly around this internal side wall without creating an undue amount of fob. The washing and rinsing liquids and the purging gases are discharged through this annular orifice 30 during washing. A bleed passage 31 is also provided adjacent the sealing ring 28 to allow washing and rinsing liquid in the neck of the container to be discharged.

The container is held onto the washing and filling head 5 by a clamping device including a pair of claws 32. These are shown in their closed position in FIG. 5 and in their open position in FIGS. 6 and 7. These claws 32 are generally C-shaped with their ends 33 being pivotally connected to a movable body portion 34. The movable body portion 34 together with sealing rings 35 and 36 and a portion 37 attached to the portion 27 form a double acting pneumatic ram. The other end of the claws 32 include a curved jaw 38 and the corner of the claws 32 adjacent the end 33 is attached and pivotally connected to a pivot 40. This pivot 40 is spring biased in the upwards direction as shown in FIG. 6 by a spring 41.

In use, after an operator has loaded the container onto the head so that its open end rests on the sealing ring 28, compressed air is supplied to the lower chamber defined by the movable body 34, the part 37 and the sealing ring 36, and this urges the movable body 34 in a downwards direction as seen in FIG. 6. This moves the ends 33 of the claws 32 downwards and causes them to pivot about the pivots 40 with the result that the jaws 38 on the other ends of the claws 32 are moved towards one another until they engage the neck 2 of the container. Further downwards movement of the body 34 causes the claws 32 to move downwards and moves the pivot points 40 downwards with them against the bias of the springs 41. The jaws 38 engage behind the collar 4 on the neck 2 of the container and urge the open end 3 of the neck 2 of the container firmly against the sealing ring 28. The container is subsequently released by venting compressed air from the lower chamber and supplying compressed air to the upper chamber formed between the body 34, part 37 and sealing ring 35.

Figure 8:
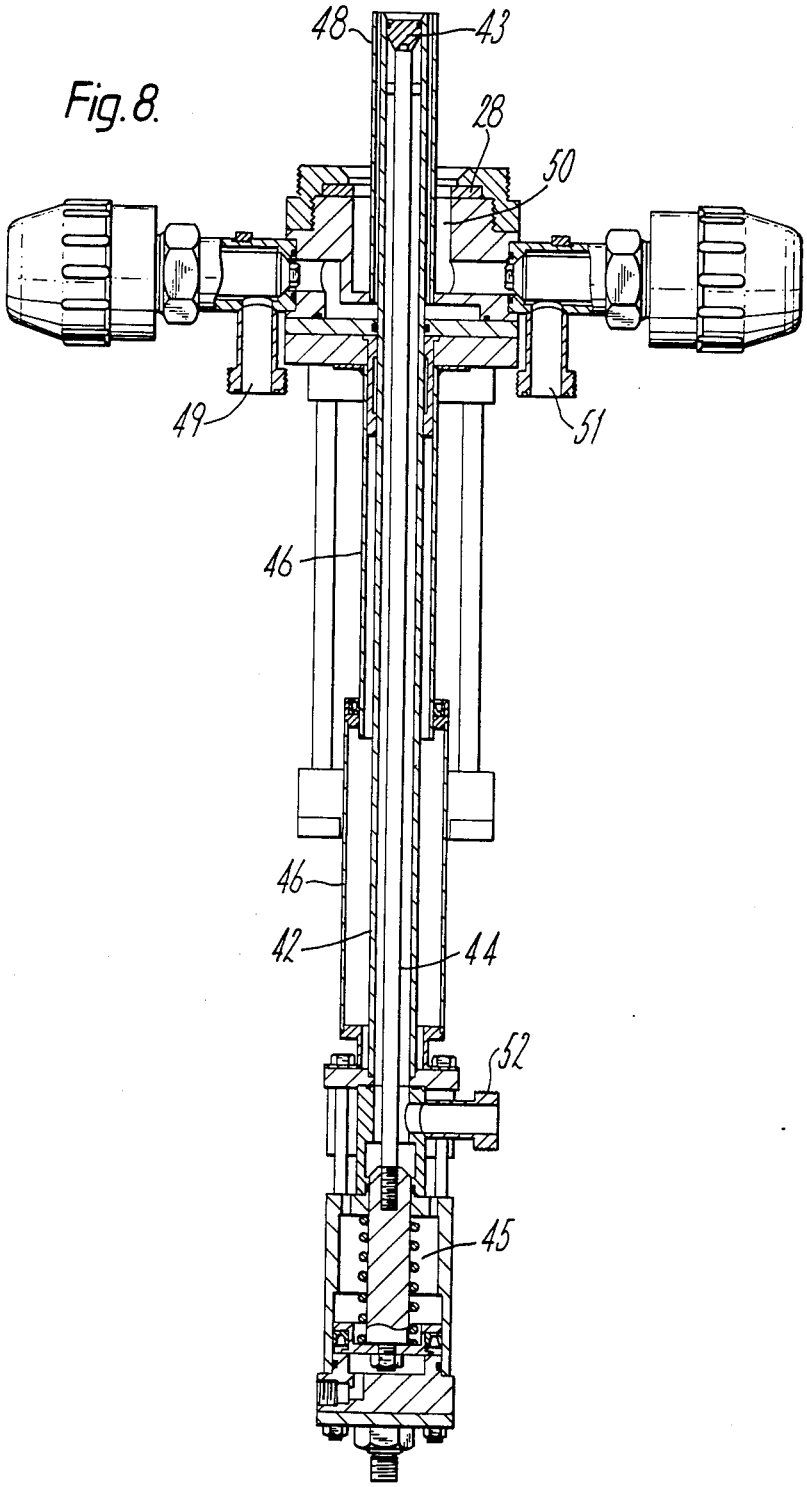
FIG. 8 is a partly sectioned front elevation of a first modification of the washing and filling head.
Figure 9:
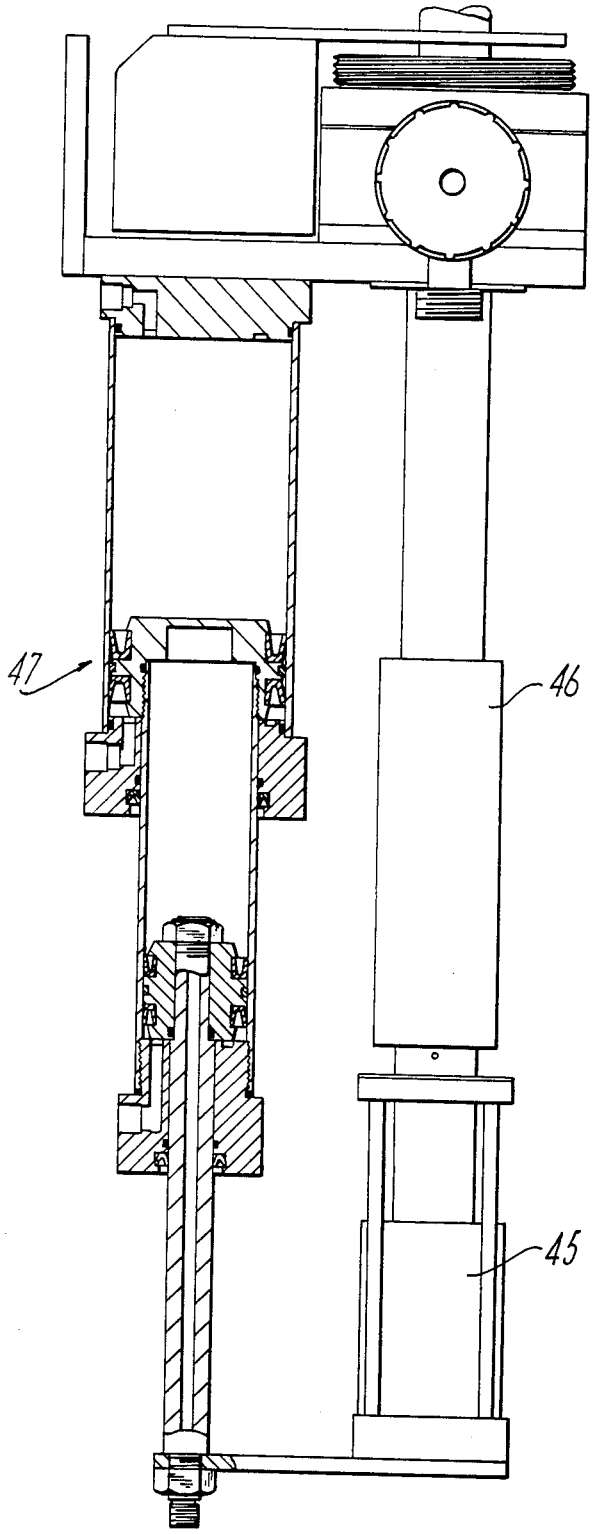
FIG. 9 is a partly sectioned side elevation of a first modification of the washing and filling head; and, FIG. 10 is a partly sectioned front elevation of a second modification of the washing and filling head.

In a first modification of the machine in accordance with this invention the washing and filling head shown in FIGS. 5, 6 and 7 is replaced by that shown in FIGS. 8 and 9. This modification includes an extendable spear to enable the beer to be introduced towards the base of the container during filling. The machine includes the same clamping device for holding the container as has just been described but these features have been omitted from FIGS. 8 and 9 for the sake of clarity.

In this first modification the head includes an elongate tubular spear 42 which is closed by a valve closure member 43 at its upper end, as shown in FIG. 8. The valve closure member 43 is connected via a push rod 44 to a single acting, spring return pneumatic piston and cylinder assembly 45 which is arranged to move the valve closure member 43 to allow beer to be discharged from the end of the spear. The spear 42 is surrounded by a telescoping cover 46 to prevent contamination of the spear and is extended and withdrawn by a telescoping two-stage double acting pneumatic ram 47 shown most clearly in FIG. 9. The head also includes a tube 48 surrounding the spear 42. Washing and rinsing liquids are introduced via inlet connection 49 and the annular space between tube 48 and the spear 42. The spent washing and rinsing liquids and purging gases are vented via an annular chamber 50 surrounding the tube 48 and an outlet 51. Beer is introduced into the inside of the spear via a connection 52.

In use, the spear is in its withdrawn position as shown in FIG. 8 during washing of the container and then, as the filling head 5 is rotated to move the container into an erect position, the pneumatic ram 47 is operated to extend the spear 42 until the valve closure member 43 is adjacent the base of the container 1. The pneumatic piston and cylinder assembly 45 is then operated to move the valve closure member 43 to allow the beer to be discharged from the end of the spear 42. Upon completion of the filling, the ram 47 is again operated to withdraw the spear 42 and enable the head 5 to be removed from the neck of the container.

Figure 10:
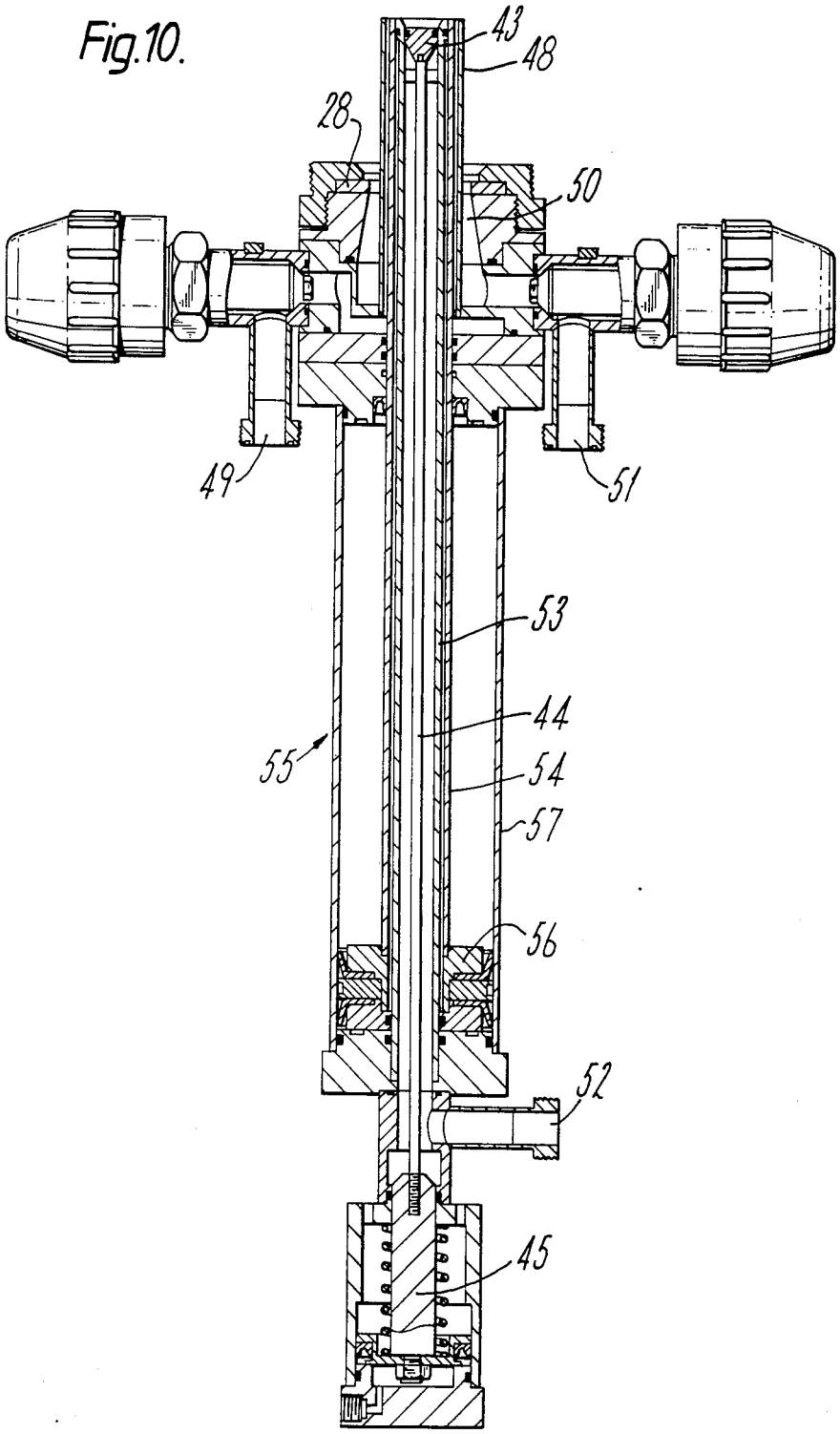

A second modification of the washing and filling head 5 which also includes an extendable spear is shown in FIG. 10. This has some similarity to the first modification and, where possible, the same reference numerals have been used for similar parts. In effect, the spear is formed by two separate parts, a first part 53 which is fixed and at the end of which the closure member 43 of the valve is located, and a movable extension 54 which surrounds the outside of the first part 53 and which is moved forwards to extend the spear to the base of the container during filling. The extension 54 forms the piston rod of a double acting pneumatic ram 55 having a piston 56 and a cylinder 57. The extension 54 is surrounded by the tube 48 and again washing and rinsing liquids are injected into the container through the annular space between the outside of the spear 54 and the inside of the tube 48. During filling the pneumatic ram 55 is actuated to extend the tube 54 until its end is adjacent the base of the container. Then the piston and cylinder assembly 45 is actuated to move the push rod 4 and open the valve closure member 43 to allow beer to be discharged from the end of the tube 53 through the extension 54 and introduced at the base of the container.

We claim:

1. A container washing and filling machine for washing and filling blow moulded containers having an open-ended neck, including only a single head through which both washing and filling liquids are introduced into said container through its said open-ended neck, means to supply a washing liquid to said single head, means to supply filling liquid to said single head, a clamping device arranged to engage and hold said open-ended neck of said container in fluid-tight sealing engagement with said single head, and moving means to move said single head and said clamping device together with said container being treated between a washing position wherein said container is inverted and a filling position wherein said container is erect, said fluid-tight sealing engagement between said single head and said open-ended neck of said container being maintained during said movement.

2. The container washing and filling machine of claim 1, also including a support, said support supporting a base of said container during filling and after said container is released by said clamping device when filling has been completed.

3. The container washing and filling machine of claim 2, wherein means are provided to move said support up and down, said means being arranged to move said support up into contact with said base of said container only after said container has been moved into its erect position by said moving means for filling.

4. The container washing and filling machine of claim 2, also including a closure unit, said closure unit applying a closure to said open-ended neck of said container after filling.

5. The container washing and filling machine of claim 1, wherein said moving means displaces said container in a horizontal plane during its movement to turn said container from its inverted position wherein it is washed to its erect position wherein it is filled.

6. The container washing and filling machine of claim 1, wherein said clamping device engages a collar surrounding said neck of said container and thereby pulls said container against said single head, said clamping device including a movable body, a fluid pressure operated ram, said fluid pressure operated ram acting between said body and said single head to move said body with respect to said head, at least two claws, said claws being pivotally connected to said movable body, and fulcrum means, said fulcrum means engaging said claws whereby downwards movement of said body caused by said ram carries said claws downwards and reaction from said fulcrum means closes said claws behind said collar on said neck of said container, further downwards movement of said body caused by said ram causing engagement of said claws with said collar and urging said container downwards to move said open ended neck of said container into fluid-tight sealing engagement with said single head.

7. The container washing and filling machine of claim 7, said fulcrum means include spring means spring biasing said fulcrum means, and wherein each of said claws is C-shaped with one end pivotally connected to said movable body and said other end being arranged to engage said collar on said neck of said container, said fulcrum means being pivotally connected to said claws at a corner of said C-shaped claws adjacent their pivotal connection with said body.

8. The container washing and filling machine of claim 1, wherein said single head includes an annular outwardly directed orifice through which said filling liquid is introduced, whereby said filling liquid is introduced in a direction generally sideways and outwards from said single head and thereby flows smoothly around a continuous internal hemispherical side wall surrounding said neck of said container.

9. The container washing and filling machine of claim 1, wherein said single washing and filling head includes an extendable spear, and means to withdraw said spear during loading and washing of said container and to extend said spear into said container until its end is adjacent said base of said container during filling.

10. The container washing and filling machine of claim 9, wherein said single washing and filling head includes a plurality of concentric tubes, a central tube providing an inlet for filling liquid, and an annular orifice around said central tube providing an inlet for washing and rinsing liquid during washing of said container.

11. The container washing and filling machine of claim 10, wherein said central tube forms said spear and is movable into and out of said container.

12. The container washing and filling machine of claim 10, wherein said spear surrounds said central tube and is movable into and out of said container effectively to extend said central tube during filling.

13. The container washing and filling machine of claim 9, wherein said means to withdraw and extend said spear is a telescoping pneumatic ram.

14. The container washing and filling machine of claim 12, wherein said means extend and withdraw said spear includes a pneumatic ram and said spear forms a piston rod of said pneumatic ram.

15. A container washing and filling machine for washing and filling blow moulded containers having an open-ended neck surrounded by a collar, said machine including: only a single head through which both washing and filling liquids are introduced into said container through its said open-ended neck;

means to supply a washing liquid to said single head;

means to supply filling liquid to said single head;

a clamping device arranged to engage and hold said open-ended neck of said container in fluid-tight sealing engagement with said single head; and, moving means to move said single head and said clamping device together with said container being treated between a washing position wherein said container is inverted and a filling position wherein said container is erect, said fluid-tight sealing engagement between said single head and said open-ended neck of said container being maintained during said movement;

said clamping device comprising a movable body;

a fluid pressure operated ram, said fluid pressure operated ram acting between said body and said single head to move said body with respect to said head;

at least two claws, said claws being pivotally connected to said movable body;

and fulcrum means, said fulcrum means engaging said claws whereby downwards movement of said body caused by said ram carries said claws downwards and reaction from said fulcrum means closes said claws behind said collar on said neck of said container, further downwards movement of said body caused by said ram causing engagement of said claws with said collar and urging said container downwards to move said open ended neck of said container into fluid-tight sealing engagement with said single head.

16. The container washing and filling machine of claim 15, also including a support, said support supporting a base of said container during filling and after said container is released by said clamping device when filling has been completed.

17. The container washing and filling machine of claim 16, wherein mans are provided to move said support up and down, said means being arranged to move said support up into contact with said base of said container only after said container has been moved into its erect position by said moving means for filling.

18. The container washing and filling maching of claim 16, also including a closure unit, said closure unit applying a closure to said open-ended neck of said container after filling.

19. The container washing and filling machine of claim 15, wherein said moving means displaces said container in a horizontal plane during its movement to turn said container from its inverted position wherein it is washed to its erect position wherein it is filled.

20. The container washing and filling machine of claim 15, wherein said single head includes an annular outwardly directed orifice through which said filling liquid is introduced, whereby said filling liquid is introduced in a direction generally sideways and outwards from said single head and thereby flows smoothly around a continuous internal hemispherical side wall surrounding said neck of said container.

* * * * *